US006059672A

United States Patent [19]

Zeiner-Gundersen

[11] Patent Number: 6,059,672

[45] Date of Patent: May 9, 2000

[54] GOLF TRAINING DEVICE PARTICULARLY FOR THE SHORT GAME

[76] Inventor: Dag H. Zeiner-Gundersen, P.O. Box 46301, Houston, Tex. 77056-8301

[21] Appl. No.: 09/106,134

[22] Filed: Jun. 29, 1998

[51] Int. Cl.[7] ..... A63R 69/36

[52] U.S. Cl. ..... 473/407; 473/404

[58] Field of Search ..... 473/407, 409, 473/404, 405, 225

[56] References Cited

U.S. PATENT DOCUMENTS

| | | | |
|---|---|---|---|
| 4,136,394 | 1/1979 | Jones et al. | 473/407 |
| 4,815,020 | 3/1989 | Cormier | 473/407 |
| 5,046,839 | 9/1991 | Krangle | 473/407 |
| 5,283,732 | 2/1994 | Mauritz | 473/407 |
| 5,294,110 | 3/1994 | Jenkins et al. | 473/407 |
| 5,582,554 | 12/1996 | Stryczek | 473/407 |
| 5,788,583 | 8/1998 | Agulnek et al. | 473/407 |
| 5,810,680 | 9/1998 | Lobb et al. | 473/407 |

*Primary Examiner*—Steven Wong
*Attorney, Agent, or Firm*—Russell J Egan

[57] ABSTRACT

An instructional device for the game of golf has housing containing therein; a micro processor, a visual display means visible from outside the housing, data input means connected to the microprocessor and a plurality of sensing means whereby the information input as data and the sensed information are processes by said micro processor to give an indication of the type of golf shot which should be taken to advance play of the game of golf.

2 Claims, 2 Drawing Sheets

GOLF TRAINING DEVICE PARTICULARLY FOR THE SHORT GAME

BACKGROUND OF THE INVENTION

1. The Field of the Invention

The present invention relates to a device for teaching the short game of golf, normally approach shots and putting, and, in particular, to a computerized device which, from sensed and inputted information, describes the shot to be taken.

2. The Prior Art

Heretofore the available golf computers have been of the type shown in U.S. Pat. No. 3,744,714 to Banner. This type of computer generally comprises a plurality of superimposed discs, on the order of a circular slide rule, each with a different diameter and with different information displayed along the circumference and at least one surface thereof. None of the information to be used is sensed, except by the golfer, who then must manually enter his perceptions of the distances etc. Such a device cannot accurately plot the next shot to be taken.

U. S. Pat. No. 3,665,494 to Baumoel relates to a device intended to calculate handicaps based on player performance, as indicated on a punched scoring card. This is not a portable device and would do little to actually train a golfer, despite the fact that it uses ". . . the same types of digital integrated circuit components as used in United States aerospace programs."(Col. 2 lines 10–13).

U.S. Pat. No. 4,910,677 to Remedio to some extent, builds upon the Baumoel teaching to come up with a computerized scoring system which relies heavily on a central computer and a plurality of remote computers. The remote computers can display a lot of information, including past performance, and suggest the next club and shot.

U.S. Pat. No. 5,056,106 to Wang et al and both U. S. Pat. Nos. 5,086,390 and 5,097,416 to Matthews are concerned with computer devices which are more directed to traffic control on a golf course than anything else. Each monitors the position of golf carts on the course and calculates distances from the cart to specific objects. The golfer would still have to make some adjustments for the distance from the cart to the ball.

U.S. Pat. No. 5,326,095 to Dudley concerns a golf cart mounted computer system utilizing location identifying tags fixed in spaced locations along each fairway to give the player his exact location on the course, or at least the location of his golf cart. This information could also be displayed at the club house or caddy shack to keep others informed of the location of players on the course.

U.S. Pat. No. 5,364,093 to Huston et al concerns another computerized device for measuring distances on a golf course. This also includes a global positioning system relay to exactly locate the player and a display of the current hole being played. The purpose of this is to give exact yardage measurements to facilitate club selection.

U.S. Pat. No. 5,507,485 to Fisher concerns a golf computer which provides visual display of the hole being played, record of the golfers's play, suggestion of club to use and relay of information to a base (caddy shack or club house).

There are a great many factors which are involved in each shot, not just the skill of the golfer. For example, the slope of the ground, the height and moisture content of the grass, the wind direction and velocity, and the distance to be covered by the shot. The present invention provides a device for coordinating input of much of the required data to display the optimum shot and the requirements to accomplish the shot.

The present invention is a computerized device for training a golfer primarily in playing the short game (approach shots and putting) aspects of the game of golf. This is the most important portion of the game of golf The drives, or Tee shots, comprise only about twenty-five percent of the number of strokes assigned for par, and, in fact, never exceed eighteen in number. Thus the majority of the shots are the "approach" shots to reach the green, after the tee shot, and putting while on the green. It is these latter shots which comprise the majority of the golfer's score.

SUMMARY OF THE INVENTION

The present invention concerns a device for improving the performance of a golfer, particularly in the short portion of the game by providing the golfer with a real time display of the shot to be taken. The device includes a plurality of sensors to determine the playing conditions; data entry on the golfer's skill level and physical size; lay of the land along the proposed trajectory of the ball; and indication of how hard the ball should be struck in directing it along the desired path.

The subject device addresses the problem of the correct club and force to be imparted by the club to the ball to achieve the desired trajectory and flight of the ball. For the purpose of addressing these issues, several parameters must be collected and interpreted by the golfer and this must therefore also form an integrated part of the device. This data is then collected and used for the purpose of setting the parameters and configurations in the device.

The subject device includes a humidity sensor; a distance measuring laser capable of scanning an area around the straight line between the ball and cup; a compass giving relative information for the calculation when scanning the putting green profile; and angle sensor measuring means (for measuring the perpendicularly to the hitting direction, and parallel with the hitting direction, and the angular position (inclination) of the device with respect to a horizontal plane); distance measuring by triangulation; grass depth and humidity measurement; wind strength and direction measurement; micro processor means to process the collected data; miniaturized LCD to display the data; optical lenses, reflective glass, and mirrors. The data from all these sensors is used to calculate the appropriate trajectory for the ball to follow while being putted across the green.

The device is provided with a fairway distance measurement means with an integrated individual golf club selector for driving with woods and irons.

A wedging and pitching (short distance) measurement means includes an integrated individual golf club selector for irons to be used for high and low lift (loft) ball curvature.

The putting mode includes an integrated display showing the desired ball roll trajectory to be selected by the golfer as well as showing the force the golfer should impart to the ball in making the putt.

BRIEF DESCRIPTION OF THE DRAWINGS

The present invention will now be described, by way of example, with reference to the accompanying drawings in which.

DETAILED DESCRIPTION OF AN EMBODIMENT OF THE INVENTION

Figure 1:
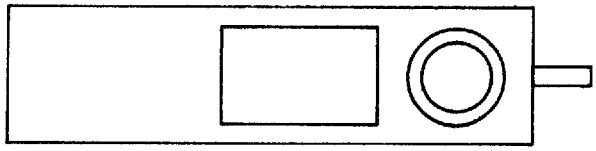
FIG. 1 is a rear elevation of the subject device.
Figure 2:
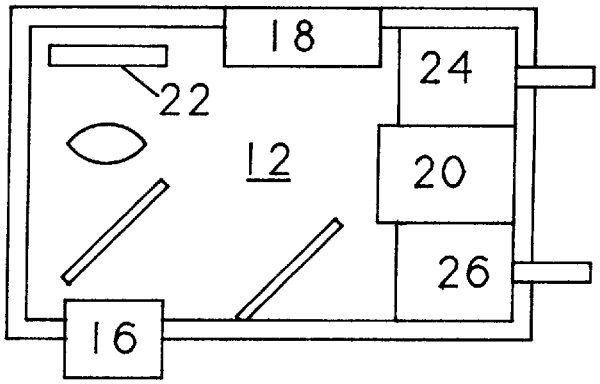
FIG. 2 is a top plan view of the subject device with the cover removed.
Figure 3:
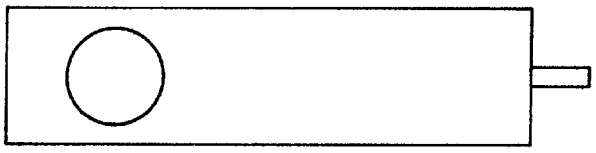
FIG. 3 is a front elevation of the subject device.
Figure 4:
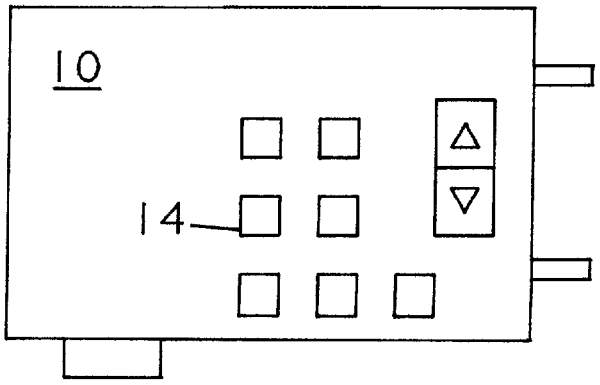
FIG. 4 is a top plan of the subject device with the cover in place.
Figure 5:
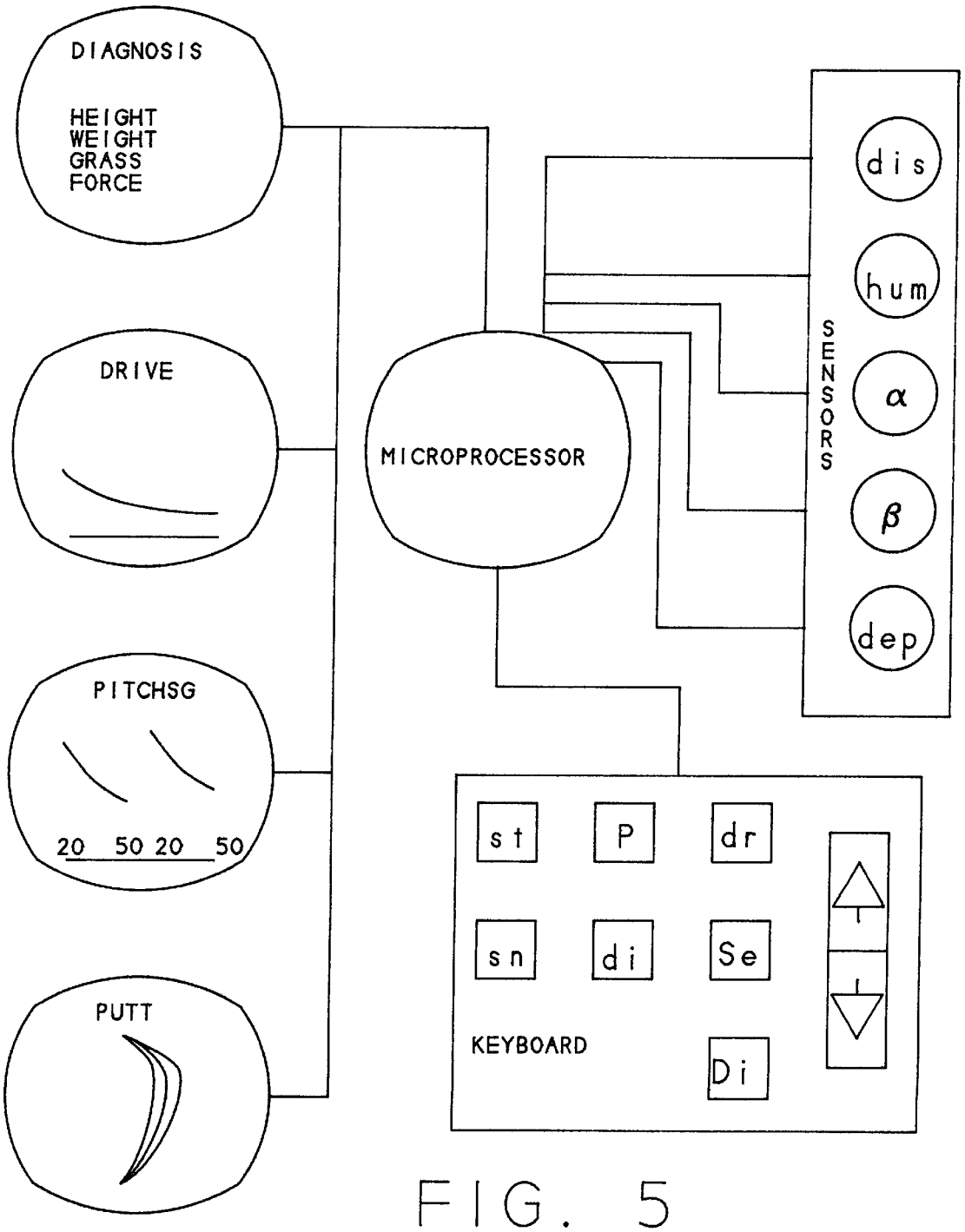
FIG. 5 is a schematic illustration of the operation of the subject device.

The subject device comprises a housing 10 defining a cavity 12 therein. Mounted on the exterior of the housing are data input means 14, a view port 16 and a sighting port 18. The interior of the housing contains a microprocessor 20 connected to both the data input means 14 and an LCD data display means 22. Also contained within the housing 10 are a plurality of sensing means including: laser distance measuring means 24; humidity sensing means 26; compass means 28; first and second angle measuring means 30, 32; grass height determining means 34; and power supply means 36.

The grass height determining (depth measuring) means 34 is preferably a spring loaded device which is activated when the golfer presses the device against the ground, the sense button depressed and then the set button depressed.

The humidity sensing means 26 is preferably located on the bottom of the device and provides information regarding the humidity of the grass and the top layer of soil by measuring the electrical conductivity. This information is fed into the microprocessor when the golfer initially presses the sense button and then, after a delay, releases the button. The humidity is measured in order to provide information regarding how "fast" the green is. High humidity in the grass will impart greater friction causing the speed of the ball to slow down while dry grass impart less friction so that the ball will maintain speed longer. The speed of the ball will affect the curvature of the ball's path as well as the distance it will travel. The humidity measuring device works in conjunction with the grass height measuring device and this information is inputted to the microprocessor to make the appropriate calculations of how the travel of the ball will be affected.

The microprocessor portion of the subject device is unitized to process the manually inputted data and the collected sensor information. A suitable microprocessor is the AT 90S8515 AVR RISC produced by the Atmel Corporation. The microprocessor will be a low powered micro-controller with a relatively high processing power and information storage capacity. The microprocessor will typically include at least one analog comparator. The software for the microprocessor will typically be a specially tailored software program capable of handling the sensor data from the laser scanner, humidity reader, compass (relative heading of the housing at any time), the inclinometer (the relative positioning of the housing with respect to a plane horizontal to the ground), the wind speed and direction sensor and the tested and calculated deacceleration of the ball while rolling on the green, and the preprogrammed equation that will be used to calculate the undulation of the green and the calculated rolling path. The calculated value for golf club selection (the club selection will be manually input) will be displayed in the form of a curve and or by other simple means. The program will typically utilize the online available sensor data, such as compass, inclinometer, wind directional and speed sensor, the calculated roll resistance, and the calculations preformed to determine the undulation, configuration and distance to the flag. This calculated data will be combined and compared with values that were originally entered, such as the height of the golfer, typical length of drives for that person, selected grass configurations for that course. The rolling performance will, at some stage in the game and preferably at the beginning of the game, be tested out. This is originally calculated while the golfer stands on a green or a practice area which is similar to that of an actual green for that golf course. The golfer throws the ball forward while aming at the ball with the training device. The device will scan and calculate the undulation of the area, check the initial speed of the ball and the speed after a time lag. By this method, information is generated to calculate the rolling speed and deacceleration of the ball under these conditions. The deacceleration is a consequence of type of grass, humidity in the grass, the relative and averaged inclination of the path the ball follows while rolling. Thus the inputted humidity sensor data is required to calculate the specific putting, and it is also required for other activities, such as pitching, chipping, sand trap hitting and the like, due to the resistance the club head will have while passing through the top layer of the soil/grass roots. The microprocessor that will calculate the necessary data to be displayed on the LCD.

The compass serves as a relative angular reference and the vertical sensor and is used in combination with the laser scanning means. Preferably an electronic compass will be utilized to provide a reference to the laser scanner to compensate for rotational movements of the housing while the inclinometer will be used for the relative verticality of housing, i.e. the movements and horizontal tilt in the plane of the housing.

The laser distance measuring means is based on a laser having the capability of scanning an area between the ball and the cup in order for the microprocessor to determine the curvature of the green and to calculate the ball trajectory for display on the miniature LCD. Thus by viewing through the unit, the actual view is overlaid by the displayed curvature on the LCD. A high performance retroflective laser scanner will be utilized for the scanning unit. The unit will have many of the characteristics found on similar scanners used on automatic bottle return machines (scanning and comparing bottle size, type, configuration, etc. to preprogrammed units).

A wind sensor means measures the velocity and direction of the ambient wind. This is more of a concern when the device is used to determine the path of drive from the Tee or an approach shot requiring a high loft. The microprocessor will calculate the anticipated angular offset based on the golfer's choice of club and the distance. A ball hit with a high loft will have wind driven offset. Wind blowing at 90° to the intended line of travel will, of course, have an effect on all shots, except putts.

A graphical LCD module screen with integrated control interface to a micro controller. The graphical LCD module will be used for displaying the calculated data and will typically have the capability of storing bit map graphical information. Typically, smaller unit of the G1216 from Seiko instruments with a 128×64 pixel resolution may be used.

The device preferably can be used by one or two players. Each player individually inputs into the device their own personal data which affects performance, such as height and weight, to generate some sort of strength reference. However, the results of testing the effect of this data may result in the data being changed to more accurately reflect the golfer's abilities. The golfer would then point the device toward the next hole and sight through the lens at the pin in that next hole. This scene will be generally viewed and, due to the configuration of the unit's reflecting prisms or fiber optics, be reproduced on a the data display 22 with the appropriate golfing instructions overlaid thereon. This display will include a proposed path of travel for the ball, considering: the wind direction and strength; any obstacle to approach shots; the curvatures of the ground to be traversed by the ball (in the case of putts); the distance to the pin; the suggested club; and statistical information on the golfer and the sensor data calculated by the microprocessor and displayed instructing the player as to how to address and hit the ball to achieve the desired results.

The golfer places the device on the ground to obtain sensor data on the humidity and the depth of the grass and to "read" the type of grass, although this may be manually input. The grass height (depth) measuring means is preferably a spring loaded device which will measure the average height (depth) of the blades of grass accurately and provide average blade height information to the microprocessor, assuming pressure on the blades of grass similar to a ball. The type, depth and condition of the grass are used to calculate the rolling resistance and the trajectory.

The distance along the fairway, from the ball to the green, will be shown and displayed by a picture overlay method that is based on simple geometry which utilizes the height of the flag combined with fitting the flag into the tangential function curvature displayed by the microprocessor on the LCD. The LCD will, in addition to the simple curvature, also show the exact information regarding the club the player should use for that distance.

The vertical angle sensors measure the position of the device relative to the vectorial direction of the gravitation, which is used in combination with the compass and laser. The data from the sensors are utilized for the calculations performed by the microprocessor. The golfer may also place the device on the ground, orient the unit so that a marked arrow on the unit is pointing from the ball to the hole and pressing a button for manual setting. The angle will be picked up while the golfer is pressing the button or subsequently releasing the button.

The sensor is activated after first aiming the device at the ball and pressing the set button and next aiming the device at the hole and again releasing the set button. The scanner will be active between these two points and the scanning action is provided by the movement of the device by the golfer in first aiming at the ball and then at the cup.

The LCD is a standard white on black industrial unit that is controlled by the microprocessor. There typically are four modes of operation available to be selected by the golfer. Each of these modes of operation has a corresponding designated LCD picture which can be viewed by looking through a lens. These LCD pictures will be overlaid on the scene the golfer is viewing through the lens. The four modes of operation are:

- the data entry mode (personal information on each golfer);
- driving mode (Tee shots);
- pitching mode (pitch and wedge shots);
- sand wedge mode (special condition shots);
- putting mode.

The data entry mode is used by the golfer to select and input the following data: selection of the type of measurements to be displayed (English or metric); the height and or weight of the golfer (to calculate the expected force which will be applied to the ball and determine the distance to the ball will be carried toward the hole); input of how far the individual golfer can hit the ball while driving with the woods or irons (this input is determined by trial and may never need to be reset unless wanted); selection of how far the individual golfer can hit the ball while pitching with high loft and with low loft (this input is determined by trial and error also); selection of type of grass; manual input of the length of the fairway grass if extremely long or short, special environmental conditions.

The driving mode will display an LCD picture which shows one curve to be matched with the marker (flag) on the green, i.e. the bottom line in the picture should be lined up with the bottom of the flag while the top of the flag should line up with one of the marks on the distance curvature. The distance curvature and the calculated club selection points on this curve are established by simple geometry by the fitting the known height of the flag under the curve. Accuract measurement for long drives is usually not critical. The unique feature in this picture will be the microprocessor's adjustment of the club selection marks on the curvature to be in accordance with the experience data inputted by the golfer in the data entry mode as well as the wind velocity and direction. If no such data is inputted, the curvature will default to the that of a normal golfer shooting with no wind.

The pitching mode will display an LCD picture which shows two curvatures to be matched with the marker (flag) on the green, i.e. the bottom line in the picture should be lined up with the bottom of the flag while the top of the flag should line up with one of the marks on the distance curvature. The right curve is for high loft, i.e. the player hits well under the ball while the left curve will be based on a low loft i.e. a stump hit is made which lets the ball have a low lift but a long roll. The distance curvatures and the corresponding calculated club selection points on this curvature are established by simple geometry by the fitting the known height of the flag under the curve. Accuracy in distance measurement for pitching is usually not critical thus allowing this traditional and simple way of measuring distance.

The unique aspect in this picture will be the microprocessor's adjustment of the club selection marks on the curvature to be in accordance with the experience data inputted by the golfer in the data entry mode as well as the adjustment of these points in accordance with how wet the grass and top soil are as well as the inputted length of the grass. If no such data is inputted the curvature will default to that of normal golfer and course conditions.

For short distances the laser may be used to obtain the distance.

The sand wedge mode will display an LCD picture which shows one curve to be matched with the marker (flag) on the green i.e. the bottom line in the picture should be lined up with the bottom of the flag while the top of the flag should line up with one of the marks on the distance curvature. The distance curvature is established by simple geometry by fitting the known height of the flag under the curve. The unique feature in this picture will be the display of the microprocessor's adjustment of the marks on the curvature to be in accordance with the experience data inputted by the golfer in the data entry mode as well as the adjustment of these points in accordance with how wet the grass and the top soil are as well and the inputted length of the grass. If the golfer is close to the hole, he may direct and point the device toward the flag and set the distance, as well as utilizing the scanning feature normally used in putting. A small point will appear on the curve and the force to be applied to the ball for it to reach the green will be displayed.

The putting mode is the most important of the modes since this is where a player can efficiently cut down on the number of strokes used for each of the holes. In preparation for this mode, the golfer will point the device place the device on the green in front of the ball and then press the set button (with the arrow directed toward the hole) and release the sensor button. The unit has now scanned and collected data from the main sensors (humidity and length of grass and scanning of the green relative to the compass and horizontal angle). The golfer will then stand behind the ball and sight toward the ball and press the distance button and repeat this process while sighting on the cup. If the grass pattern, for some reason, should be tilted against, forward, or to either side, A, F, RS, or LS may be selected to input this relevant information into the microprocessor. If no such information is selected, the microprocessor will go to the default settings. A curvature will now be displayed on the screen and overlaid over the golfer's view of the green. Absent an input, the microprocessor will use default information.

The golfer will fit the curve in between the ball and the cup and memorize the curvature path and or look for irregularities on the green and remember to curve the ball when he is hitting it so as to follow the desired curvature.

A small window will display information regarding how hard the golfer should hit the ball. The microprocessor will calculate this by combining the information from each of the sensors. The data is partially calculated and partially based on experience data, by comparing the rolling action versus the effect of the gravitational pull to achieve the ideal path of the ball.

An attachment means (not shown) may be provided to allow the device to be hung from the golfer's belt or bag. The device can also be provided with other standard golfing accessories, such as a multi tined divot repair means or cleat cleaner.

The present invention may be subject to many modifications and changes without departing from the spirit or essential characteristics of the present invention. Therefor the foregoing embodiment should be considered in all ways as being illustrative and not restrictive of the scope of the present invention as defined by the appended claims.

I claim:

1. An instructional device for the game of golf, comprising:

housing means defining a cavity therein;

micro processor means located within said cavity;

display means visible from outside the housing and connected to said micro processor means;

data input means on said housing and connected to said micro processor means; and sensing means connected to said micro processor and including: humidity sensing means for determining the moisture content of a grass surface: grass height measuring means; said humidity measuring means and said grass height measuring means together determining the speed of a ball over the grass; laser means for measuring and scanning the area between the ball and a target cup; compass means giving relative directional information for determining the direction of path of the ball to said target cup; angle sensing means measuring verticality distance; distance measuring means utilizing triangulation; and means to measure the direction and velocity of prevailing winds, whereby information input as data and the sensed information are processed by said micro processor to give an indication of the type of golf shot which should be taken to advance play of the game of golf.

2. The instructional device according to claim 1 wherein said stored data obtained during the play may be electronically transferred to another unit or a computer for use in statistical collection and comparison and to overlay into purpose built golf game plays.

* * * * *